US009240171B1

(12) United States Patent
Satoh

(10) Patent No.: US 9,240,171 B1
(45) Date of Patent: Jan. 19, 2016

(54) ELECTRONIC MUSICAL INSTRUMENT

(71) Applicant: Kabushiki Kaisha Kawai Gakki Seisakusho, Hamamatsu-shi, Shizuoka-ken (JP)

(72) Inventor: Takuya Satoh, Hamamatsu (JP)

(73) Assignee: Kabushiki Kaisha Kawai Gakki Seisakusho, Hamamatsu-shi (JP)

( * ) Notice: Subject to any disclaimer, the term of this patent is extended or adjusted under 35 U.S.C. 154(b) by 0 days.

(21) Appl. No.: 14/835,325

(22) Filed: Aug. 25, 2015

(30) Foreign Application Priority Data

Sep. 8, 2014 (JP) ..... 2014-182533

(51) Int. Cl.
*G10H 1/32* (2006.01)
*G10H 3/00* (2006.01)
*G10H 1/02* (2006.01)

(52) U.S. Cl.
CPC ... *G10H 1/02* (2013.01); *G10H 1/32* (2013.01)

(58) Field of Classification Search
CPC ..... G10D 3/02; G10D 13/085; G10C 3/06; G10C 1/00; G10C 3/02; G10C 3/00; G10C 3/04; G10C 3/12; G10C 3/161; G10C 1/04; G10C 3/22; G10C 1/02; G10H 1/32; G10F 1/02; G10F 5/00; G10F 3/00; G10F 1/16; G10G 5/00; H04R 7/04; H04R 11/02; H04R 1/02; H04R 1/01
See application file for complete search history.

(56) References Cited

U.S. PATENT DOCUMENTS 5,247,129 A * 9/1993 Nozaki ..... G10H 1/055 84/192
2008/0127798 A1* 6/2008 Sato ..... G10H 3/146 84/192
2013/0061733 A1* 3/2013 Ohnishi ..... G10C 3/06 84/174
2014/0202318 A1* 7/2014 Ohnishi ..... G10C 3/06 84/723

FOREIGN PATENT DOCUMENTS

JP 11-32388 2/1999

* cited by examiner

*Primary Examiner* — Marlon Fletcher
(74) *Attorney, Agent, or Firm* — Christie, Parker & Hale, LLP

(57) ABSTRACT

An electronic musical instrument capable of providing spatially spread and dynamic musical tones by causing mutual resonance of first and second vibration exciters for vibrating an opposition board and a soundboard opposed to each other, respectively. A first vibration exciter provided on a surface, opposed to a soundboard, of a opposition board, and driven according to a musical tone signal, for vibrating the opposition board to generate a musical tone, and a second vibration exciter provided on a surface, opposed to the opposition board, of the soundboard and driven according to the musical tone signal for vibrating the soundboard to generate a musical tone is connected by a connecting member for causes the first and second vibration exciters to resonate with each other.

6 Claims, 6 Drawing Sheets

ELECTRONIC MUSICAL INSTRUMENT

CROSS-REFERENCE TO RELATED APPLICATION(S)

This application claims priority of Japanese Patent Application Number 182533/2014, filed on Sep. 8, 2014, the entire content of which is incorporated herein by reference.

BACKGROUND OF THE INVENTION

1. Field of the Invention

The present invention relates to an electronic musical instrument that generates a musical tone according to a musical tone signal generated based on an operated state of an operating element for musical performance.

2. Description of the Related Art

As a conventional loudspeaker unit that generates a musical tone according to an electric signal, there has been known one disclosed e.g. in Japanese Laid-Open Patent Publication (Kokai) No. H11-32388. This loudspeaker unit is comprised of a cabinet, a loudspeaker, and a vibration exciter. The loudspeaker is mounted on a baffle board covering the front of the cabinet, and the vibration exciter is mounted on a backboard covering the rear of the cabinet. The loudspeaker receives an audio signal from an audio amplifier, and sound is generated from the loudspeaker according to the audio signal. The same audio signal as received by the loudspeaker is input to the vibration exciter as well, and the vibration exciter vibrates the cabinet according to the audio signal so as to cancel vibration of the cabinet caused by the generation of the sound from the loudspeaker. Thus, the conventional loudspeaker unit prevents movement of the cabinet due to vibration of the cabinet caused by the generation of sound from the loudspeaker.

Further, in recent years, there has been known an electronic musical instrument, such as an electronic keyboard instrument, which generates a musical tone according to a musical tone signal generated based on a depressed state of a key. When the above-described conventional loudspeaker unit is applied to an electronic musical instrument of this type, the following inconvenience occurs: Since the vibration exciter is configured to excite the cabinet not to generate a musical tone, but to cancel vibration of the cabinet caused by the generation of sound from the loudspeaker, as described above, a musical tone is output exclusively from the loudspeaker disposed in the front of the cabinet. Therefore, the electronic musical instrument equipped with the conventional loudspeaker unit is not capable of providing spatially spread musical tones characterizing an electronic musical instrument.

Further, in the conventional loudspeaker unit, the loudspeaker and the vibration exciter are simply attached to the cabinet independently of each other, so that the sound pressure of a musical tone generated by the electronic musical instrument cannot be increased sufficiently, and therefore it is impossible to obtain dynamic musical tones characterizing an electronic musical instrument.

SUMMARY OF THE INVENTION

It is an object of the present invention to provide an electronic musical instrument which is capable of providing spatially spread and dynamic musical tones by causing mutual resonance between a first vibration exciter and a second vibration exciter for vibrating an opposition board and a soundboard opposed to the opposition board, respectively.

To attain the above object, the present invention provides an electronic musical instrument that generates a musical tone according to a musical tone signal generated based on an operated state of an operating element for musical performance, comprising a soundboard, an opposition board opposed to the soundboard, a first vibration exciter that is provided on a surface, which is opposed to the soundboard, of the opposition board, and is configured to vibrate the opposition board by being driven according to the musical tone signal, to thereby generate a musical tone, a second vibration exciter that is provided on a surface, which is opposed to the opposition board, of the soundboard in a manner opposed to the first vibration exciter, and is configured to vibrate the soundboard by being driven according to the musical tone signal, to thereby generate a musical tone, and a connecting member that is connected to the first and second vibration exciters and is configured to cause the first and second vibration exciters to resonate with each other.

With the construction of the electronic musical instrument according to the present invention, the first and second vibration exciters are provided on the respective surfaces, which are opposed to each other, of the opposition board and the soundboard, and the two vibration exciters are driven according to a musical tone signal to vibrate the opposition board and the soundboard, respectively, whereby musical tones are generated. Thus, a musical tone is generated by each of the opposition board and the soundboard opposed to each other, so that spatially spread musical sound can be obtained.

Further, the first and second vibration exciters are connected to each other by the connecting member for causing the two vibration exciters to resonate with each other, and hence when the first and second vibration exciters are driven, the two vibration exciters resonate with each other, whereby the opposition board and the soundboard can be largely vibrated. Therefore, it is possible to increase the sound pressure of each musical tone and obtain dynamic musical sound. Further, the above-mentioned advantageous effect of providing spatially spread and dynamic musical sound can be obtained by making use of the existing opposition board which is a component of the electronic musical instrument.

Preferably, a first cushion for suppressing resonance of the opposition board is disposed between the first vibration exciter and the opposition board, and a second cushion for suppressing resonance of the soundboard is disposed between the second vibration exciter and the soundboard, wherein the first and second cushions have respective vibration characteristics different from each other.

With the construction of this preferred embodiment, since the first cushion for suppressing resonance of the opposition board is disposed between the first vibration exciter and the opposition board, it is possible to suppress the resonance of the opposition board to thereby suppress the peak dip of the frequency characteristic of a musical tone from the opposition board. Similarly, since the second cushion for suppressing resonance of the soundboard is disposed between the second vibration exciter and the soundboard, it is possible to suppress the resonance of the soundboard to thereby suppress the peak dip of the frequency characteristic of a musical tone from the soundboard. From the above, it is possible to obtain excellent musical sound. Further, the first and second cushions have respective vibration characteristics different from each other, and hence in a case where the opposition board and the soundboard are different in resonance characteristic (natural frequency), the vibration characteristic of the first cushion and that of the second cushion are set according to the resonance characteristic of the opposition board and that of the soundboard, respectively, such that the two vibration characteristics differ from each other. This makes it possible to more effectively obtain the above-mentioned advantageous effect of suppressing the resonance of the opposition board and that of the soundboard.

Preferably, the electronic musical instrument is an upright electronic piano in which the operating element is a key, and the electronic piano further comprises a keybed on which the key is placed, and a toe rail disposed below the keybed, wherein the opposition board is a panel secured to the keybed and the toe rail in a manner covering a side forward of the soundboard without any gap.

With the construction of this preferred embodiment, a side forward the soundboard is covered by the panel as the opposition board without any gap, which makes it possible to prevent a musical tone from the soundboard and a musical tone from the panel from canceling each other by mutual interference. Therefore, it is possible to appropriately obtain the above-mentioned advantageous effect of providing spatially spread and dynamic musical sound.

More preferably, cushions for suppressing resonance of the panel are provided between the panel and the keybed and between the panel and the toe rail.

With the construction of this preferred embodiment, the cushions for suppressing the resonance of the panel are disposed between the panel and the keybed and between the panel and the toe rail. This makes it possible to suppress the resonance of the panel, and hence it is possible to suppress the peak dip of the frequency characteristic of a musical tone from the panel and in turn it is possible to obtain excellent musical sound. Further, the effect provided by these cushions is combined with the effects provided by the first and second cushions, whereby it is possible to obtain more excellent musical sound.

The above and other objects, features, and advantages of the present invention will become more apparent from the following detailed description taken in conjunction with the accompanying drawings.

DETAILED DESCRIPTION OF PREFERRED EMBODIMENTS

Figure 1:
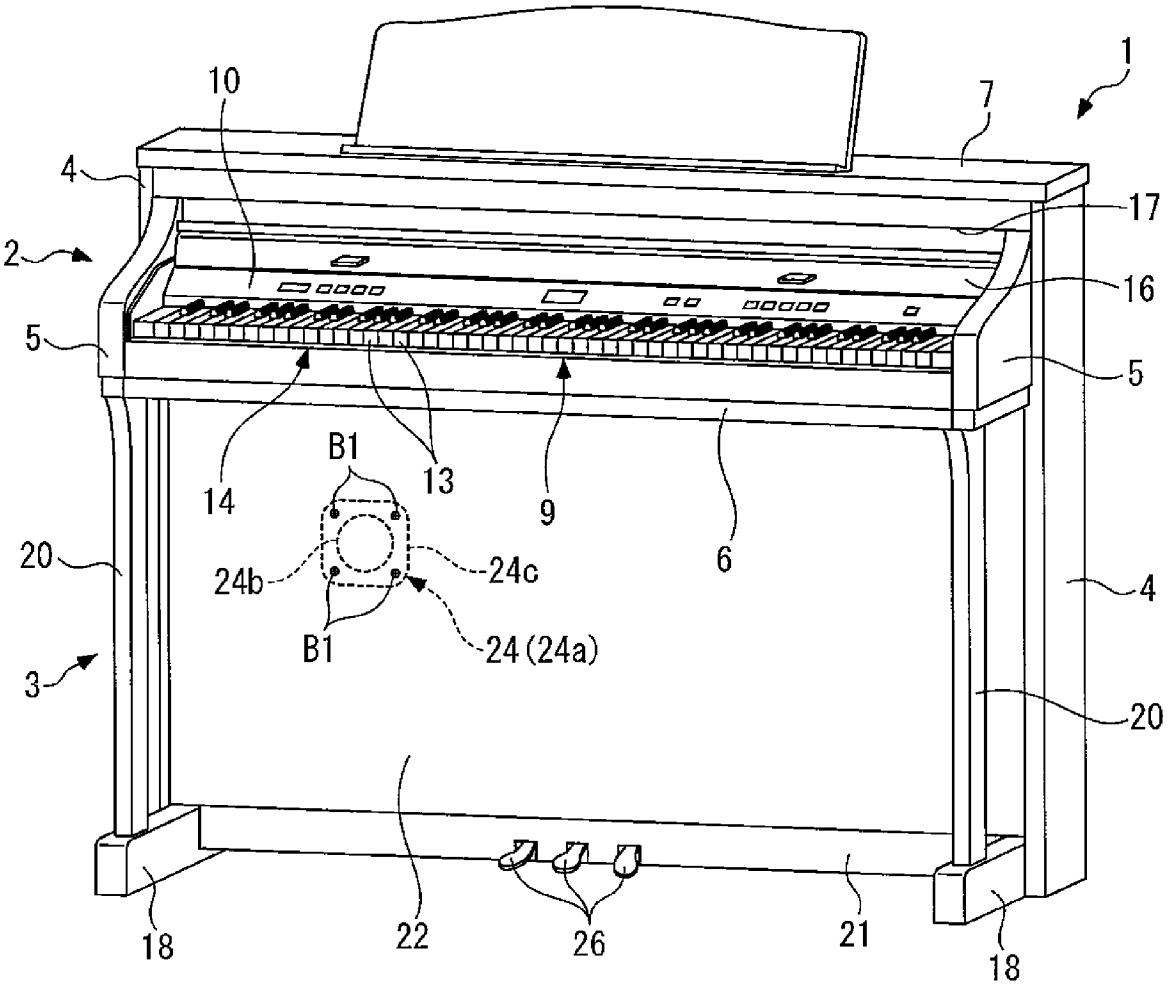
FIG. 1 is a perspective view of an upright electronic piano according to an embodiment of the present invention.
Figure 2:
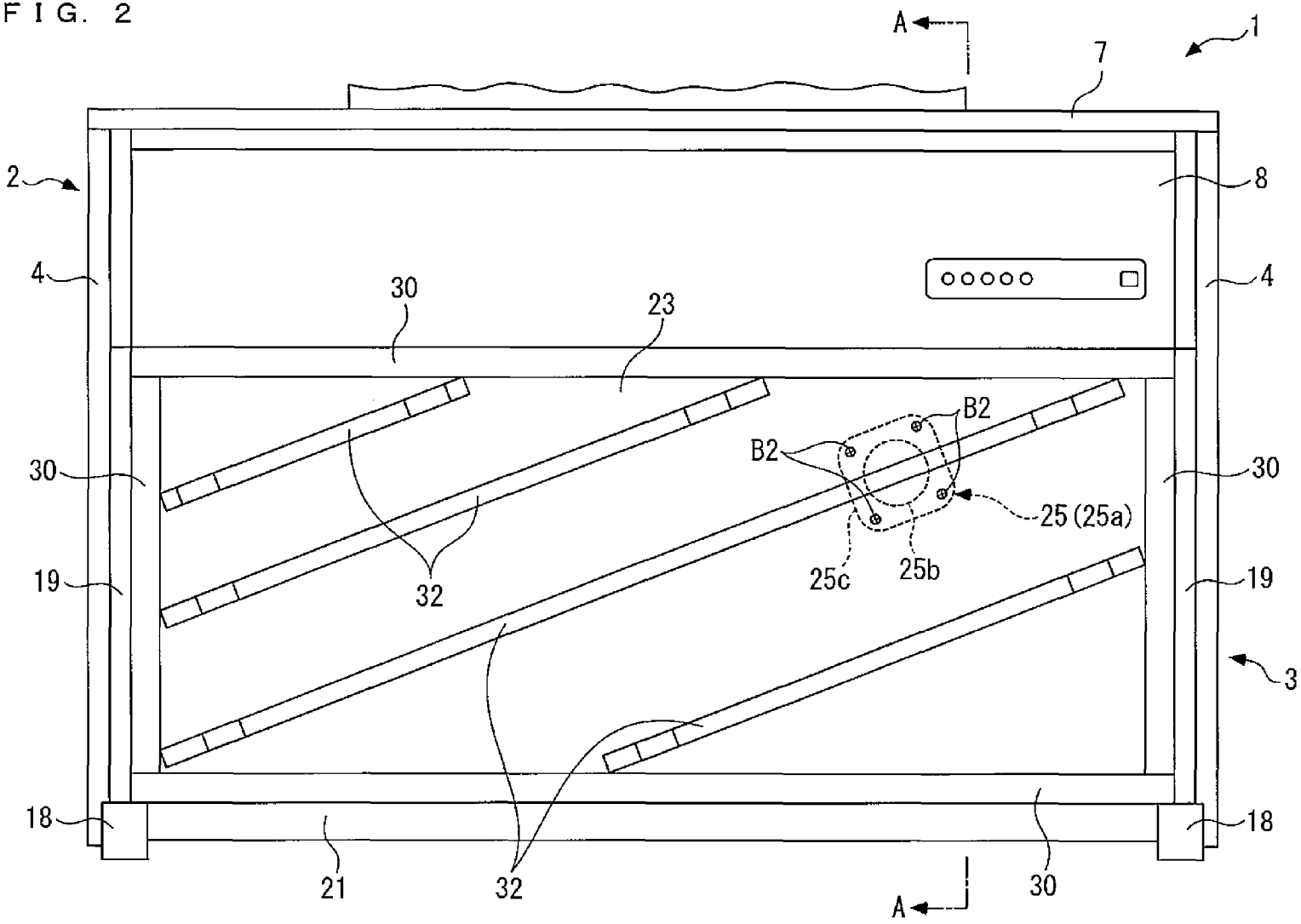
FIG. 2 is a rear view of the electronic piano shown in FIG. 1.
Figure 3:
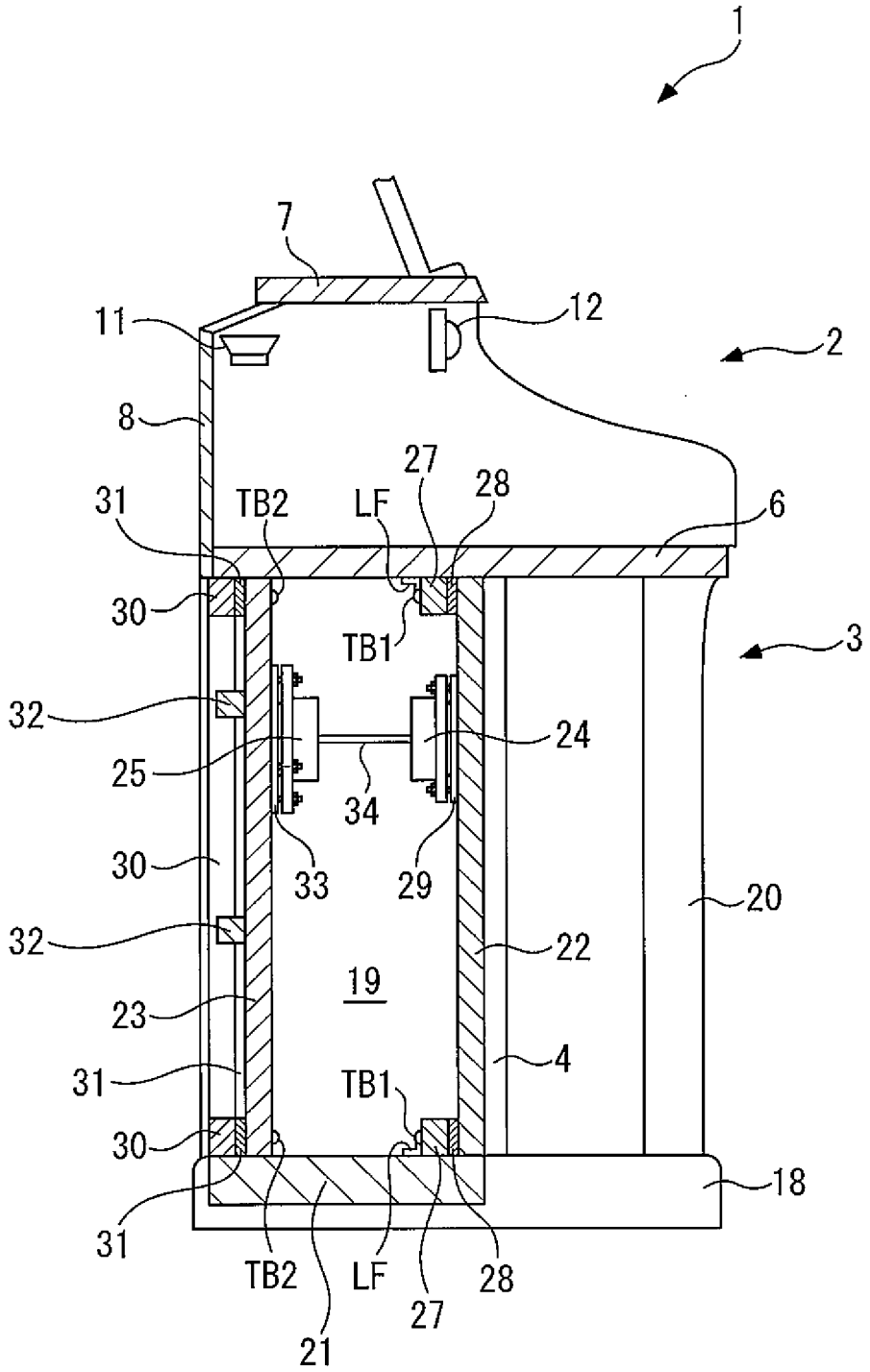
FIG. 3 is a cross-sectional view taken on line A-A of FIG. 2.

The present invention will now be described in detail with reference to the drawings showing a preferred embodiment thereof. As shown in FIGS. 1 to 3, an upright electronic piano 1 (electronic musical instrument) according to the present embodiment is comprised of a piano body 2 and a stand unit 3 for supporting the piano body 2. In the following description, a near side, a far side, a left side, and a right side, as viewed from the player, of the electronic piano will be referred to as "front", "rear", "left", and "right", respectively.

On the left and right sides of the piano body 2 and the stand unit 3, there are mounted end panels 4 and 4, respectively, in a manner covering the piano body 2 and the stand unit 3. The piano body 2 has an exterior formed by left and right arms 5 and 5, a keybed 6 extending horizontally between the lower ends of the respective arms 5 and 5, a topboard 7 extending horizontally between the upper ends of the respective arms 5 and 5, and a back plate 8 for covering between the rear ends of the respective arms 5 and 5. Within the piano body 2, there are disposed a keyboard device 9, an operation panel 10, middle and high-pitched sound loudspeakers 11, and high-pitched sound loudspeakers 12.

The keyboard device 9 is comprised of a keyboard 14 having a plurality of keys 13 (operating elements) arranged side by side in the left-right direction on the keybed 6, a plurality of hammers (not shown) provided for the respective keys 13 and each configured to pivotally move in accordance with key depression of an associated key 13, and a plurality of key sensors (not shown) provided for the respective keys 13 and each configured to detect key depression information of an associated key 13. The key 13 is basically made of a wood material and has substantially the same construction as that of a key of an acoustic upright piano. The key 13 is pivotally supported at its center. The key sensor is formed e.g. by a rubber switch and detects execution/non-execution (on/off) and key depression speed (velocity) of depression of an associated key 13 via a hammer that pivotally moves in accordance with depression of the associated key 13. Note that in FIG. 1, some of reference numerals of the keys 13 are omitted for convenience' sake.

The operation panel 10 is disposed above the keyboard 14, and is provided with operation buttons and levers for use in setting a tone color, a tone volume, an acoustic effect, etc. for the electronic piano 1, and a display for displaying the settings.

The middle and high-pitched sound loudspeakers 11 are formed by four mid-range loudspeakers, and each basically reproduce a middle and high-pitched sound component of a musical tone. The loudspeakers 11 are disposed in the upper left and right rear ends of the piano body 2, with their sound emission surfaces facing upward. The high-pitched sound loudspeakers 12 are formed by two dome tweeters and each basically reproduce a high-pitched sound component of a musical tone. The loudspeakers 12 are disposed in the upper left and right ends of the piano body 2, in facing relation to an opening 17 (see FIG. 1) for sliding of a fallboard 16 and with their sound emission surfaces facing forward.

The stand unit 3 is a box-shaped assembly formed by left and right toe blocks 18 and 18, left and right side boards 19 and 19, left and right legs 20 and 20, a toe rail 21, a lower panel 22 (opposition board), a soundboard 23, and so forth. On the lower panel 22, there is provided a panel vibration exciter 24 (first vibration exciter) for vibrating the lower panel 22 to thereby generate a musical tone, and the lower panel 22 and the panel vibration exciter 24 form a loudspeaker. On the other hand, on the soundboard 23, there is provided an soundboard vibration exciter 25 (second vibration exciter) for vibrating the soundboard 23 to thereby generate a musical tone, and the soundboard 23 and the soundboard vibration exciter 25 form a soundboard loudspeaker. The lower panel 22 and the panel vibration exciter 24 and the soundboard 23 and the soundboard vibration exciter 25 are disposed symmetrical with respect to each other in the front-rear direction (see FIG. 3).

The toe rail 21 is connected between the rear ends of the respective toe blocks 18 and 18 and extend in the left-right direction, with three pedals 26 pivotally movably provided in a central portion thereof (see FIG. 1). Each of the pedals 26 is provided with a pedal sensor (not shown) for detecting execution/non-execution (on/off) of operation of the pedal 26. Note that in FIG. 3, the pedals 26 are omitted for convenience' sake.

The lower panel 22 is made of a wood material and has a laterally elongated rectangular shape. The lower panel 22 is secured to the keybed 6 and the toe rail 21, and covers the front end of a space enclosed by the keybed 6, the toe rail 21, and the side boards 19 and 19 (the space will be hereinafter referred to as "the stand space") without any gap.

Specifically, the lower panel 22 is secured to the keybed 6 and the toe rail 21 as follows: The rear surface of the lower panel 22 has upper and lower ends thereof each formed with a plurality of prepared holes (not shown) arranged side by side in the left-right direction and each extending in the front-rear direction. On the other hand, the keybed 6 and the toe rail 21 have wood pieces 27 attached to a central portion of the lower surface of the keybed 6 and the front end of the upper surface of the toe rail 21, via L-shaped metal fittings LF, respectively, and extend in the left-right direction. Each of the wood pieces 27 is formed with a plurality of prepared holes (not shown) in a manner associated with the respective prepared holes of the lower panel 22, and each of the prepared holes of the wood pieces 27 extends therethrough in the front-rear direction. The lower panel 22 is secured to the keybed 6 and the toe rail 21 by screwing a tapping screw TB1 into each of the prepared holes of the wood pieces 27 and the associated one of the respective prepared holes of the lower panel 22 from the rear side in the mentioned order.

Figure 4:
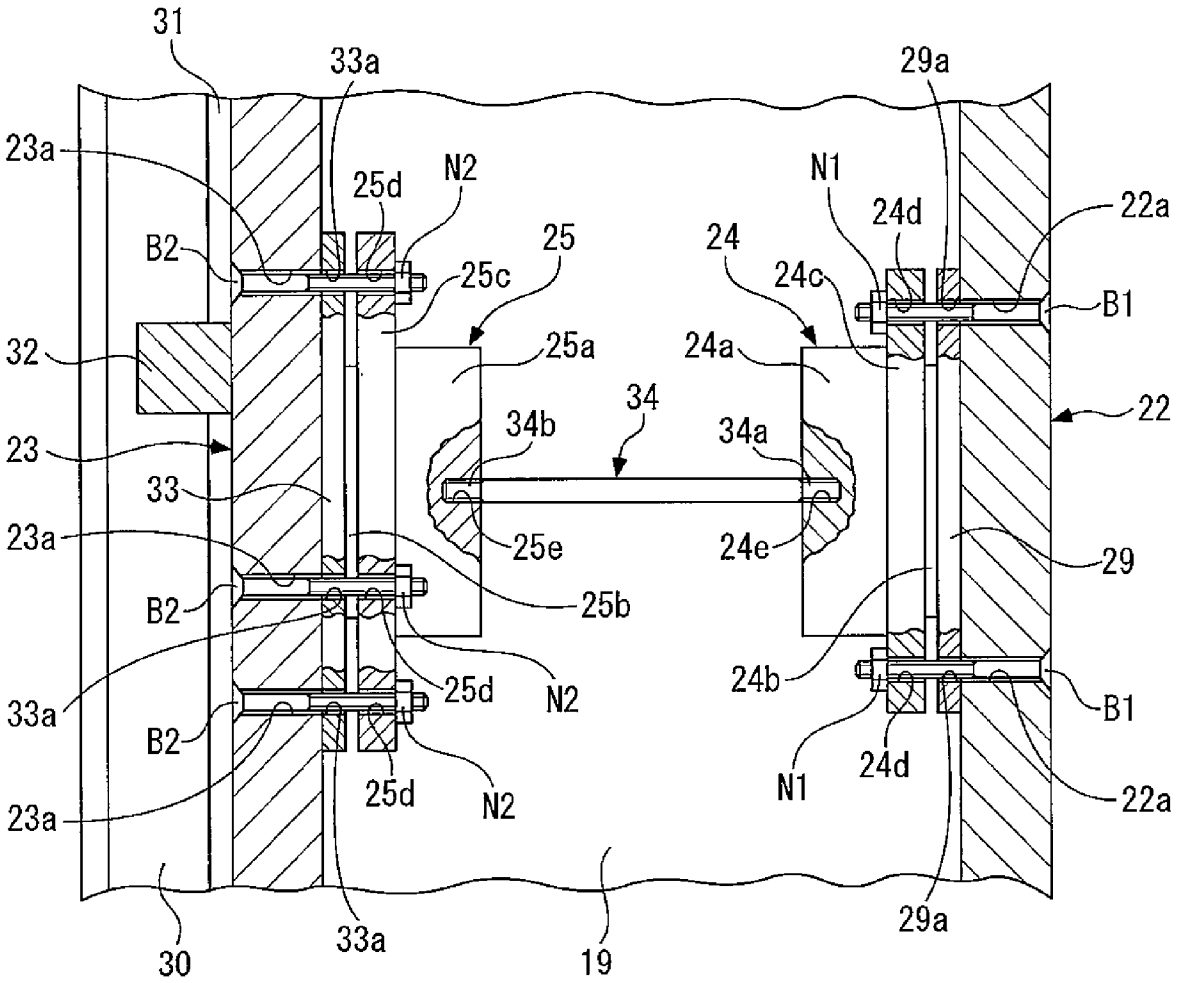
FIG. 4 is an enlarged cross-sectional view, partly broken away, of a panel vibration exciter, a soundboard vibration exciter, and so forth.

Between the lower panel 22 and each of the wood pieces 27, there is disposed a panel cushion 28 (cushion) for suppressing resonance of the lower panel 22. The panel cushion 28 is formed e.g. of PORON (registered trademark, model number: HH-48) manufactured by Rogers Inoac Corporation. The panel cushion 28 is formed in a board shape, and the thickness thereof is set, by experiment or the like, to a predetermined value according to a resonance characteristic (natural frequency) of the lower panel 22. Further, in the rear surface of the lower panel 22, at a predetermined location slightly closer to a low-pitched range with respect to the center thereof, there are formed a plurality of mounting holes 22*a* for use in mounting the panel vibration exciter 24 (see FIG. 4) and each mounting hole 22*a* extends through the lower panel 22 in the front-rear direction. The number of the mounting holes 22*a* is set e.g. to four, and only two of them are shown in FIG. 4. FIG. 4 shows a cross section of a different portion of the electronic piano 1 from the portion shown in FIG. 3, on an enlarged scale.

The panel vibration exciter 24 is an electromagnetic vibration exciter having a vibration characteristic that it vibrates in a predetermined frequency band (e.g. 30 Hz to 2 kHz), and is comprised of a body part 24*a* and an excitation part 24*b* for imparting vibration to the lower panel 22, as shown in FIGS. 1 and 4. The body part 24*a* has a flange 24*c* protruding outward from the outer peripheral surface of a bottom (front end) thereof. The flange 24*c* has a planar surface, which is orthogonal to the front-rear direction, formed in a rectangular shape, and has four corners (see FIG. 1). The four corners of the flange 24*c* are formed with insertion holes 24*d*, respectively (only two of which are shown in FIG. 4), and each insertion hole 24*d* extends through the flange 24*c* in the front-rear direction. Further, in the top (rear end) of the body part 24*a*, there is formed a screw hole 24*e* extending in the front-rear direction.

Between the lower panel 22 and the panel vibration exciter 24, there is disposed a first cushion 29 for suppressing resonance of the lower panel 22. Similar to the panel cushion 28 described hereinabove, the first cushion 29 is formed e.g. of PORON (model number: HH-48). The first cushion 29 is formed in a board shape, and the thickness thereof is set, by experiment or the like, e.g. to 9 mm according to the resonance characteristic of the lower panel 22. Further, the first cushion 29 is formed with a plurality of insertion holes 29*a* in a manner associated with the respective insertion holes 24*d* of the panel vibration exciter 24, and each insertion hole 24*d* extends through the first cushion 29 in the front-rear direction. The number of the insertion holes 29*a* is set to four, and only two of them are shown in FIG. 4. A countersunk screw B1 is inserted into each of the mounting holes 22*a* of the lower panel 22, the associated one of the insertion holes 29*a* of the first cushion 29, and the associated one of the insertion holes 24*d* of the panel vibration exciter 24 in the mentioned order, and nuts N1 are fastened on the respective countersunk screws B1 from the rear side, whereby the panel vibration exciter 24 is secured to the rear surface of the lower panel 22.

Similar to the soundboard of an acoustic upright piano, the soundboard 23 is formed in a laterally elongated rectangular shape by joining a plurality of solid wood board materials e.g. of spruce. The soundboard 23 has a different resonance characteristic (natural frequency) from that of the lower panel 22. A rim 30 is mounted along the outer periphery of the rear end of the stand space, and the soundboard 23 is secured to the front surface of the rim 30 as follows: Each of the upper, lower, left, and right ends of the soundboard 23 has a plurality prepared holes (not shown) formed therein in parallel with each other, and each prepared hold extends through the soundboard 23 in the front-rear direction. The rim 30 has a plurality prepared holes (not shown) formed therein in a manner associated with the respective prepared holes of the soundboard 23 and each prepared hole of the rim 30 extends in the front-rear direction. The soundboard 23 is secured to the front surface of the rim 30 by screwing a tapping screw TB2 into each of the prepared holes of the soundboard 23 and an associated one of the prepared holes of the rim 30 from the front side in the mentioned order. The soundboard 23 is disposed parallel to the lower panel 22 in a manner opposed to the lower panel 22 and covers the rear end of the stand space, without any gap.

Further, between the soundboard 23 and the rim 30, there is disposed an soundboard cushion 31 for suppressing resonance of the soundboard 23. Similar to the panel cushion 28, the soundboard cushion 31 is formed e.g. of PORON (model number: HH-48). The soundboard cushion 31 is formed in a board shape, and the thickness thereof is set, by experiment or the like, to a different predetermined value from the thickness of the lower panel cushion 29 according to the resonance characteristic (natural frequency) of the soundboard 23. Further, on the rear surface of the soundboard 23, there are mounted a plurality of sound ribs 32. The sound ribs 32 serve to enhance the transmission rate of vibration on the soundboard 23, and extend parallel to each other. Furthermore, in the soundboard 23, at a predetermined location slightly closer to the low-pitched range side with respect to the center thereof, there are formed a plurality of mounting holes 23*a* (see FIG. 4) for use in mounting the soundboard vibration exciter 25, and each mounting hole 23*a* extends through the soundboard 23 in the front-rear direction. The number of the mounting holes 23*a* is set e.g. to four, and only three of them are shown in FIG. 4.

The soundboard vibration exciter 25 is e.g. an electromagnetic-type vibration exciter having the same construction as that of the lower panel vibration exciter 24, and is comprised of a body part 25*a* and an excitation part 25*b* for imparting vibration to the soundboard 23, as shown in FIGS. 2 and 4. The body part 25*a* has a flange 25*c* protruding outward from the outer peripheral surface of a bottom (rear end) thereof. The flange 25*c* has a planar surface, which is orthogonal to the front-rear direction, formed in a rectangular shape, and has four corners (see FIG. 2). The four corners of the flange 25*c* are formed with insertion holes 25*d*, respectively (only three of which are shown in FIG. 4), and each insertion hole 25*d* extends through the flange 25*c* in the front-rear direction. Further, in the top (rear end) of the body part 25*a*, there is formed a screw hole 25*e* extending in the front-rear direction.

Between the soundboard 23 and the soundboard vibration exciter 25, there is disposed a second cushion 33 for suppressing the resonance of the soundboard 23. Similar to the first cushion 29 described hereinabove, the second cushion 33 is formed e.g. of PORON (model number: HH-48). The second cushion 33 is formed in a board shape, and the thickness thereof is set, by experiment or the like, e.g. to 6 mm, i.e. a smaller thickness than that of the first cushion 29, according to the resonance characteristic of the soundboard 23. Further, the second cushion 33 is formed with a plurality of insertion holes 33*a* in a manner associated with the respective insertion holes 25*d* of the soundboard vibration exciter 25, and each insertion hole 33*a* extends through the second cushion 33 in the front-rear direction. The number of the insertion holes 33*a* is set to four, and only three of them are shown in FIG. 4. A countersunk screw 32 is inserted into each of the mounting holes 23*a* of the soundboard 23, the associated one of the insertion holes 33*a* of the second cushion 33, and the associated one of the insertion holes 25*d* of the soundboard vibration exciter 25 from the rear side in the mentioned order, and nuts N2 are fastened on the respective countersunk screws B2 from the front side, whereby the soundboard vibration exciter 25 is secured to the front surface of the soundboard 23.

The panel vibration exciter 24 and the soundboard vibration exciter 25, which are constructed as described above, are arranged on a straight line extending in the front-rear direction in a manner opposed to each other. Further, a connecting member 34 is connected between the panel vibration exciter 24 and the soundboard vibration exciter 25, for causing the two vibration exciters 24 and 25 to resonate with each other. The connecting member 34 is formed of iron and in a bar shape, and extends in the front-rear direction. The connecting member 34 has front and rear ends thereof formed with respective screws 34*a* and 34*b*. The screws 34*a* and 34*b* are screwed into the screw hole 24*e* of the panel vibration exciter 24 and the screw hole 25*e* of the soundboard vibration exciter 25, respectively, whereby the connecting member 34 is connected to the two vibration exciters 24 and 25.

Further, the electronic piano 1 is provided with a tone generator implemented by an ECU including a CPU, a RAM, and a ROM (none of which are shown). Detection signals from the aforementioned key sensors and pedal sensors are input to this tone generator. The tone generator generates a drive signal, according to a program stored in the ROM in response to the input detection signals, and then inputs the generated drive signal to the panel vibration exciter 24 and the soundboard vibration exciter 25. This causes the panel vibration exciter 24 and the soundboard vibration exciter 25 to be driven by the drive signal generated based on a depressed state of a key 13 and others, whereby each of the lower panel 22 and the soundboard 23 is vibrated, thereby generating musical tones. In this case, the panel vibration exciter 24 and the soundboard vibration exciter 25 are driven by the drive signal such that the two vibration exciters 24 and 25 vibrate in respective phases opposite to each other (e.g. phases shifted from each other by 180 degrees) so as to vibrate the lower panel 22 and the soundboard 23 in the same phase. This is because the two vibration exciters 24 and 25 are disposed, with the connecting member 34 therebetween, in symmetrical relation in the front-rear direction, as shown in FIGS. 3 and 4.

Figure 5:
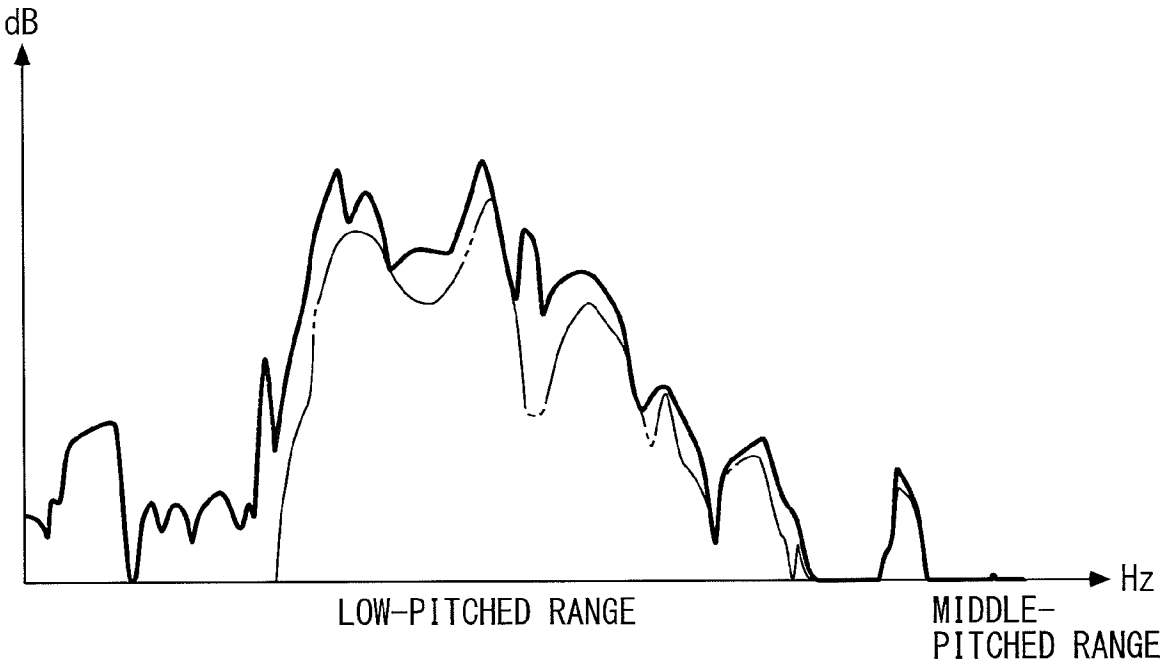
FIG. 5 is a diagram showing the relationship between the frequency of a musical tone generated by the electronic piano according to the present embodiment and the sound pressure of the same, together with a first comparative example.

FIG. 5 shows the relationship (indicated by a thick solid line) between frequency (Hz) and sound pressure (dB) of a musical tone from the electronic piano 1, which were measured at a player point (position of a player's ear), together with a first comparative example (indicated by a thin two-dot chain line). The first comparative example shows a different case from the present embodiment, where only the soundboard has a vibration exciter mounted thereon and the lower panel does not. In FIG. 5, the frequency is represented logarithmically. As shown in FIG. 5, according to the present embodiment, it is possible not only to obtain larger sound pressure than in the first comparative example, but also to obtain sound pressure even in a lower-pitched range.

Figure 6:
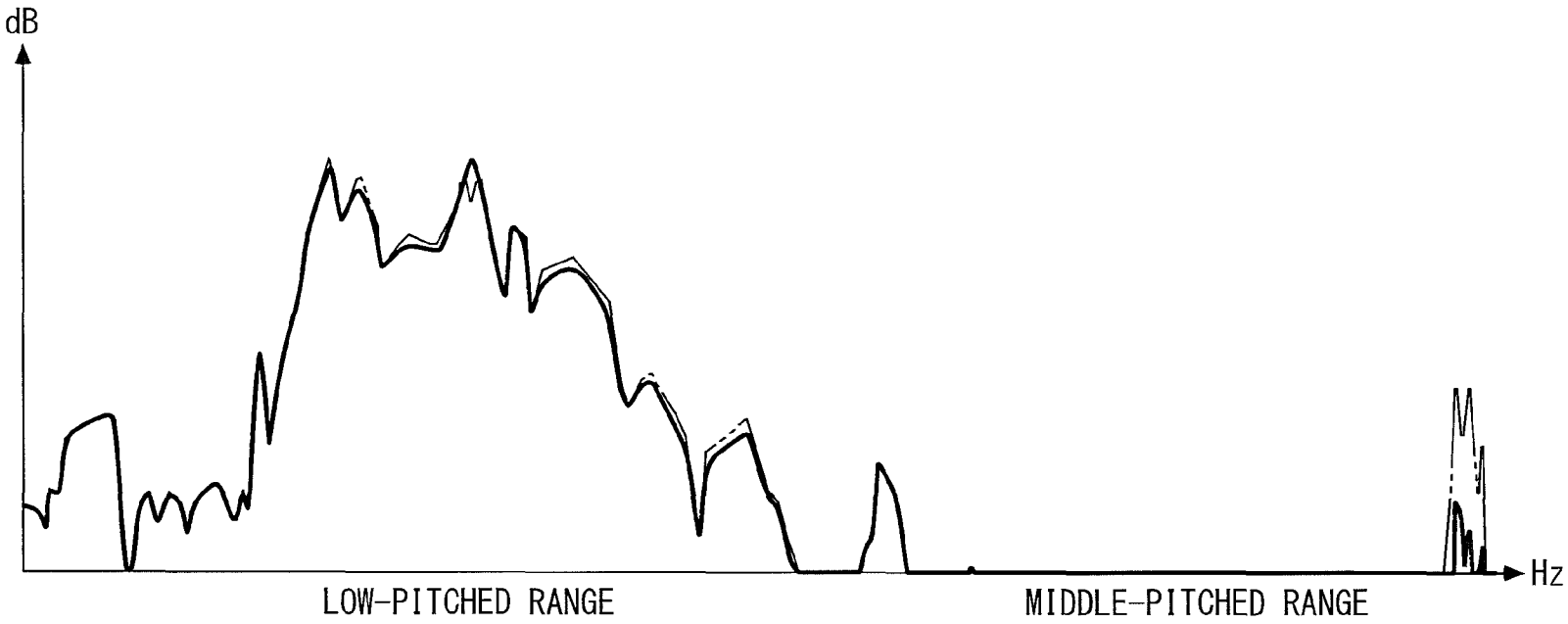
FIG. 6 is a diagram showing the relationship between the frequency of a musical tone generated by the electronic piano according to the present embodiment and the sound pressure of the same, together with a second comparative example.

FIG. 6 shows the relationship (indicated by a thick solid line) between frequency (Hz) and sound pressure (dB) of a musical tone from the electronic piano 1, which were measured at the player point, together with a second comparative example (indicated by a thin two-dot chain line). The second comparative example shows a case where the thickness of the first cushion and that of the second cushion are both set to 6 mm. Similar to FIG. 5, the frequency is represented logarithmically in FIG. 6. As shown in FIG. 6, according to the present embodiment, it is possible to further suppress the peak dip of the frequency characteristic of the musical tone in the middle and high-pitched range than in the second comparative example.

As described above, according to the present embodiment, the panel vibration exciter 24 and the soundboard vibration exciter 25 are provided on the respective surfaces, which face each other, of the lower panel 22 and the soundboard 23, and when driven according to detection signals generated based e.g. on the depressed state of a key 13 and others, the two vibration exciters 24 and 25 vibrate the lower panel 22 and the soundboard 23, respectively, whereby musical tones are generated. Thus, musical tones are generated by both the lower panel 22 and the soundboard 23 opposed to each other, and hence it is possible to obtain spatially spread musical sound.

Further, the panel vibration exciter 24 and the soundboard vibration exciter 25 are connected to each other by the connecting member 34 so as to cause the two vibration exciters 24 and 25 to resonate with each other, and hence when the panel vibration exciter 24 and the soundboard vibration exciter 25 are driven, the two vibration exciters 24 and 25 resonate with each other whereby the lower panel 22 and the soundboard 23 can be largely vibrated. Therefore, it is possible to increase the sound pressures of musical tones and thereby obtain dynamic musical sound. Further, the above-mentioned advantageous effect, i.e. the effect of providing spatially spread and dynamic musical sound can be obtained by making use of the existing lower panel 22 which is a component of the electronic piano 1.

Further, since the first cushion 29 for suppressing resonance of the lower panel 22 is disposed between the panel vibration exciter 24 and the lower panel 22, it is possible to suppress resonance of the lower panel 22 to thereby suppress the peak dip of the frequency characteristic of a musical tone from the lower panel 22. Similarly, since the second cushion 33 for suppressing resonance of the soundboard 23 is disposed between the soundboard vibration exciter 25 and the soundboard 23, it is possible to suppress resonance of the soundboard 23 to thereby suppress the peak dip of the frequency characteristic of a musical tone from the soundboard 23. From the above, it is possible to obtain excellent musical tones. Further, the thickness of the first cushion 29 and that of the second cushion 33 are set to respective values different from each other according to the resonance characteristic of the lower panel 22 and that of the soundboard 23, respectively, whereby the two cushions 29 and 33 have respective different vibration characteristics corresponding, respectively, to the resonance characteristic of the lower panel 22 and that of the soundboard 23. This makes it possible to effectively provide the advantageous effect of suppressing the resonance of the lower panel 22 and that of the soundboard 23.

Furthermore, the side forward of the soundboard 23 is covered by the lower panel 22 without any gap. This makes it possible to prevent a musical tone from the soundboard 23 and a musical tone from the lower panel 22 from canceling each other by mutual interference, and hence it is possible to appropriately obtain the advantageous effect of obtaining spatially spread and dynamic musical sound.

What is more, the panel cushions 28 for suppressing resonance of the lower panel 22 are disposed, respectively, between the lower panel 22 and the keybed 6 and between the lower panel 22 and the toe rail 21. This makes it possible to suppress the resonance of the lower panel 22, and hence it is possible to suppress the peak dip of the frequency characteristic of a musical tone from the lower panel 22, and in turn, it is possible obtain excellent musical sound. Further, this advantageous effect is combined with the resonance suppression effect provided by the first cushion 29, whereby it is possible to obtain more excellent music sound.

It should be noted that the present invention is not limited to the above-described embodiment, but it can be practiced in various forms. For example, although in the present embodiment, the panel vibration exciter 24 and the soundboard vibration exciter 25 are arranged on the straight line extending in the front-rear direction (i.e. orthogonal to the lower panel 22 and the soundboard 23), they may be arranged on a straight line extending obliquely with respect to the lower panel 22 and the soundboard 23. Further, although in the present embodiment, the connecting member 34 is formed of iron, another appropriate material, such as synthetic resin or wood, can be employed. Furthermore, although in the present embodiment, the connecting member 34 is formed in a bar shape, it may be formed in another appropriate shape, such as a board shape.

In addition, although in the present embodiment, the number of the panel vibration exciter 24, the number of the soundboard vibration exciter 25, and the number of the connecting member 34 are all set to one, each number may be set to two or more. In this case, by making a plurality of panel vibration exciter and soundboard vibration exciter different in frequency characteristic, there may be separately provided a panel vibration exciter and a soundboard vibration exciter for the high-pitched range, a panel vibration exciter and a soundboard vibration exciter for the middle-pitched range, and a panel vibration exciter and a soundboard vibration exciter for the low-pitched range. Further, although in the present embodiment, each of the first and second cushions 29 and 33 is formed of PORON, any other material, such as urethane foam or rubber, which is suitable for suppressing the resonance of the lower panel 22 and the soundboard 23 may be used to form the cushions 29 and 33. Furthermore, in the present embodiment, the first and second cushions 29 and 33 are formed of the same material (PORON), and the thickness of the first cushion 29 and that of the second cushion 33 are set to the respective values different from each other so as to make the two cushions 29 and 33 different in frequency characteristic. However, the two cushions 29 and 33 may be made different in frequency characteristic by using respective materials different from each other to form them or by making the densities or strengths of them different from each other. The above-mentioned variations of the first and second cushions 29 and 33 apply to the panel cushion 28 and the soundboard cushion 31.

Although in the above-described embodiment, the present invention is applied to the electronic piano 1 which does not have an upper panel, the invention can also be applied to an electronic piano having an upper panel. In this case, the panel vibration exciter may be provided on at least one of the upper and lower panels. Further, although in the above-described embodiment, the present invention is applied to the upright electronic piano 1, it is to be understood that the invention can also be applied to a grand electronic piano, as well as to any other appropriate electronic musical instrument, such as a percussion-type electronic musical instrument. In a case where the present invention is applied to a grand electronic piano, a keybed on which a keyboard and others are placed corresponds to an opposition board of the invention.

It is further understood by those skilled in the art that the foregoing are preferred embodiments of the invention, and that various changes and modifications may be made without departing from the spirit and scope thereof.

What is claimed is:

1. An electronic musical instrument that generates a musical tone according to a musical tone signal generated based on an operated state of an operating element for musical performance, comprising:

a soundboard;

an opposition board opposed to said soundboard;

a first vibration exciter that is provided on a surface, which is opposed to said soundboard, of said opposition board, and is configured to vibrate said opposition board by being driven according to the musical tone signal, to thereby generate a musical tone;

a second vibration exciter that is provided on a surface, which is opposed to said opposition board, of said soundboard in a manner opposed to said first vibration exciter, and is configured to vibrate said soundboard by being driven according to the musical tone signal, to thereby generate a musical tone; and a connecting member that is connected to said first and second vibration exciters and is configured to cause said first and second vibration exciters to resonate with each other.

2. The electronic musical instrument according to claim 1, wherein a first cushion for suppressing resonance of said opposition board is disposed between said first vibration exciter and said opposition board, and a second cushion for suppressing resonance of said soundboard is disposed between said second vibration exciter and said soundboard, and wherein said first and second cushions have respective vibration characteristics different from each other.

3. The electronic musical instrument according to claim 1, wherein the electronic musical instrument is an upright electronic piano in which the operating element is a key, the electronic piano further comprising a keybed on which said key is placed, and a toe rail disposed below said keybed, and wherein said opposition board is a panel secured to said keybed and said toe rail in a manner covering a side forward of said soundboard without any gap.

4. The electronic musical instrument according to claim 2, wherein the electronic musical instrument is an upright electronic piano in which the operating element is a key, the electronic piano further comprising a keybed on which said key is placed, and a toe rail disposed below said keybed, and wherein said opposition board is a panel secured to said keybed and said toe rail in a manner covering a side forward of said soundboard without any gap.

5. The electronic musical instrument according to claim 3, wherein cushions for suppressing resonance of said panel are provided between said panel and said keybed and between said panel and said toe rail.

6. The electronic musical instrument according to claim 4, wherein cushions for suppressing resonance of said panel are provided between said panel and said keybed and between said panel and said toe rail.

* * * * *